US006227194B1

(12) United States Patent
Barudi et al.

(10) Patent No.: US 6,227,194 B1
(45) **Date of Patent: *May 8, 2001**

(54) FIREPLACE

(75) Inventors: Samir E. Barudi, Huntington Beach; Rodger Duke Mitchell, Long Beach; John R. Kelly, deceased, late of Huntington Beach, all of CA (US), by Audrea D. Kelly, legal representative

(73) Assignee: Superior Fireplace Company, Fullerton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/635,887

(22) Filed: Aug. 10, 2000

Related U.S. Application Data

(63) Continuation of application No. 09/236,036, filed on Jan. 22, 1999

(60) Provisional application No. 60/072,206, filed on Jan. 22, 1998.

(51) Int. Cl.[7] ..... F24C 3/00; F24C 3/02; F24C 3/04

(52) U.S. Cl. ..... 126/512; 126/112; 126/84; 126/504; 126/502; 431/125; 237/47; 237/46; 454/239; 454/256

(58) Field of Search ..... 126/512, 502, 126/503, 504, 508, 84; 431/125; 237/46, 47, 48; 454/239, 256

(56) References Cited

U.S. PATENT DOCUMENTS

| | | | | |
|---|---|---|---|---|
| 1,365,912 | * | 1/1921 | Greene . | |
| 2,877,834 | * | 3/1959 | Campbell | 158/1 |
| 4,185,612 | * | 1/1980 | Briner et al. | 126/122 |
| 4,609,346 | * | 9/1986 | Siccardi | 432/222 |
| 5,282,770 | * | 2/1994 | Shibata | 454/239 |
| 5,775,408 | * | 12/1998 | Shimek et al. | 126/512 |
| 5,960,789 | * | 10/1999 | Fleming | 126/512 |
| 6,003,507 | * | 12/1999 | Flick et al. | 126/512 |
| 6,019,099 | * | 2/2000 | Shimik et al. | 126/512 |
| 6,026,800 | * | 2/2000 | Barker | 126/4 |

FOREIGN PATENT DOCUMENTS

| | | | |
|---|---|---|---|
| 57-101226 | * | 6/1982 | (JP) . |
| 62-225837 | * | 10/1987 | (JP) . |
| 3-164637 | * | 7/1991 | (JP) . |
| 8-170841 | * | 7/1996 | (JP) . |

OTHER PUBLICATIONS

Optional Heating Flexibility, Brochure (1 Page).*

Guardian Tubular Solenoids, Newark, p. 608 (1 Page).*

Hurst AC & DC Motors, Newark, p. 625 (1 Page).*

* cited by examiner

*Primary Examiner*—Carl D. Price
(74) *Attorney, Agent, or Firm*—Christie, Parker & Hale, LLP

(57) ABSTRACT

A gas fireplace is provided having a plenum formed around at least a portion of the fireplace firebox. Room air enters the plenum and is heated by the firebox prior to venting back into the room. Two openings are provided from the outside of the fireplace housing to the plenum. The first opening allows heated air to exit the plenum, while the second opening allows cool outside air to enter the plenum. a mechanism is provided to control the amount of heated air exiting the first opening and the amount of cool air entering the second opening. By controlling the inflow and outflow through the first and second openings, respectively, the amount of the fireplace by-products generated into the room where the fireplace is located such as carbon-monoxide, nitrogen dioxide, heat and moisture are reduced.

17 Claims, 8 Drawing Sheets

FIREPLACE

CROSS REFERENCE TO RELATED APPLICATION

This application is a continuation of U.S. patent application Ser. No. 09/236,036 filed on Jan. 22, 1999 which claims the benefit of U.S. provisional patent application Ser. No. 60/072,206, filed Jan. 22, 1998, the contents of both of which are fully incorporated herein by reference.

FIELD OF THE INVENTION

This invention relates to gas fireplaces and heaters and more particularly to a room exhausting gas fireplace in which the amount of exhaust products, heat and moisture vented into a room are controlled without sacrifice of flame appearance.

BACKGROUND OF THE INVENTION

In a gas fireplace, a combustible gas, e.g., natural gas or propane, is mixed with a source of oxygen, e.g., air, and burned. In a ventless gas fireplace, air is drawn into the combustion chamber or firebox of the fireplace typically from the room in which the fireplace is situated, and hot exhaust gases containing combustion products including carbon monoxide, carbon dioxide, nitrogen dioxide and water are vented directly into the room.

In gas fireplaces, it is desirable to adjust the air/gas ratio to create a bright yellow flame which mimics the flame produced in a wood burning fireplace. Such a flame, however, tends to produce an undesirably high level of emission products. This is particularly troublesome in a ventless fireplace which has strict emission requirements. For example, the ANSI standard for carbon monoxide emission is no more than 200 ppm. The ANSI standard for nitrogen dioxide is no more than 20 ppm. To control these emissions, an operator typically uses a clean burning blue flame, sacrificing the more aesthetically pleasing yellow flame.

Another problem associated with the use of a ventless fireplace is the generation of too much water vapor which is vented directly into a room. This not only creates high humidity, but if the fireplace is used frequently, there is a possibility of moisture condensation on the walls or other objects within the room. Yet another problem associated with ventless fireplaces is the generation of too much heat.

One method for controlling the amount of carbon monoxide and nitrogen dioxide in the exhaust of a ventless fireplace is through the use of a catalytic converter. Such a use is described in U.S. patent application Ser. No. 08/509,426 and patent application entitled "GAS FIREPLACE", filed Oct. 1, 1996, naming French, et al. as inventors. While this method is useful in controlling carbon monoxide and nitrogen dioxide levels in the exhaust, it does nothing to control the amount of moisture in the exhaust or the amount of heat generated by the fireplace. Currently, the only way to control the amount of heat and moisture generated by a ventless fireplace and vented into a room is to reduce the amount of combustion, i.e., reduce the size or quality of the flame or shut off the fireplace. Reduction or elimination of the flame diminishes the aesthetic look and appeal for which the fireplace was designed.

There is therefore, a need for a means by which an operator can control the amount of heat and moisture vented into a room by a ventless gas fireplace.

SUMMARY OF THE INVENTION

The present invention provides a factory built fireplace in which the amount of heat exhausted from the fireplace into the room in which the fireplace is located may be controlled without changing the size or color of the flame within the fireplace. The gas fireplace comprises a housing and a firebox within the housing. A plenum is provided between the firebox and the housing from which heated gases are vented into the room in which the fireplace is located. First and second openings are provided through the housing wall into the plenum. A first vent pipe is attached to the housing in surrounding relation to the first opening so that the interior of the first vent pipe is in communication with the plenum. A second vent pipe is attached to the housing in surrounding relationship to the second opening so that the interior of the second vent pipe is also in communication with the plenum. The second opening is downstream from the first opening. When the gas fireplace is installed in a room, the vent pipes extend through a wall of the room, preferably an exterior wall of the room. The first and second openings and vent pipes are located so that heated air may be withdrawn from the plenum through the first vent pipe and cool air may be introduced into the plenum through the second vent pipe. Means are provided for controlling the amount of heated air withdrawn from the plenum and cool air introduced into the plenum through the first and second vent pipes.

A preferred means for controlling the amount of heated air withdrawn from the plenum through the first vent pipe and cool air introduced into the plenum through the second vent pipe comprises means for reversibly blocking the vent pipes. A particularly preferred reversibly blocking means comprises at least one door which is movable between a closed position blocking passage of air through at least one and preferably both vent pipes and an open position wherein passage of air through the vent pipes is minimally restricted. Means are also provided for controllably moving the door or doors between its open and closed positions. The door may be movable in any fashion, e.g., slidably movable, hingedly movable or rotatably movable. Preferred means for controllably moving the door comprises a movable handle and a linkage which is connected at one end to the handle and at the other end to the door whereby movement of the handle results in movement of the door. Alternatively, movement of the door or doors may be controlled by an electric motor or the like. The electric motor may be activated by electrical switches accessible to an operator or, for example, by a thermostat. In yet another embodiment of the invention, movement of the door is controlled automatically by a thermally responsive mechanism such as a bi-metal spring.

In a preferred embodiment, the fireplace further comprises means for preventing cool air entering the plenum through the second vent pipe from passing into the firebox or combustion chamber. In one embodiment of the invention, such means comprises a baffle which extends across at least a portion of the plenum between the first and second openings preventing cool air entering the plenum from the second opening from flowing in an upstream direction toward the opening into the firebox or combustion chamber. Alternatively, such means may comprise a fan located within the plenum which directs air in a downstream direction thus preventing cool air entering the plenum through the second vent pipe from flowing upstream toward the fire opening into the firebox or combustion chamber.

In another aspect of the invention, there is provided an adapter for a ventless gas fireplace. The adapter comprises first and second vent pipes which are attachable to the housing in surrounding relation to first and second openings made in the housing. Each of the vent pipes are sufficient length to extend from the fireplace through a selected wall of the room in which the fireplace is located. Means are provided for controllably restricting the flow of air through at least one and preferably both of the first and second vent pipes. A particularly preferred means for controllably restricting the flow of air through the first and second vent pipes comprises a pair of baffles rotatably mounted within each of the first and second vent pipes. The baffles are mounted on a rod which extends through the first and second vent pipes whereby rotational movement of the rod results in rotational movement of the baffles within the vent pipes. A linkage and handle are connected to the rod such that movement of the handle results in rotational movement of the rod and baffles. The baffles are movable between a closed position or when the baffles are transverse to the access of the vent pipes and an open position wherein the plane of the baffles is generally along the access of the vent pipes. Preferably, means are provided for preventing the flow of air through the first vent pipe into the plenum and for preventing the flow of air through the second vent pipe out of the plenum.

BRIEF DESCRIPTION OF THE DRAWINGS

These and other features and advantages of the present invention will be better understood by reference to the following detailed description when considered in conjunction with the accompanying drawings, wherein.

DETAILED DESCRIPTION

As used herein, the term "room-exhausting gas fireplace" is meant to include any factory built gas fireplace in which all or a part of the exhaust products from the combustion chamber are vented into the room in which the fireplace is situated. "Factory built gas fireplaces" include freestanding fireplaces, zero clearance fireplaces and fireplace inserts.

Figure 1:
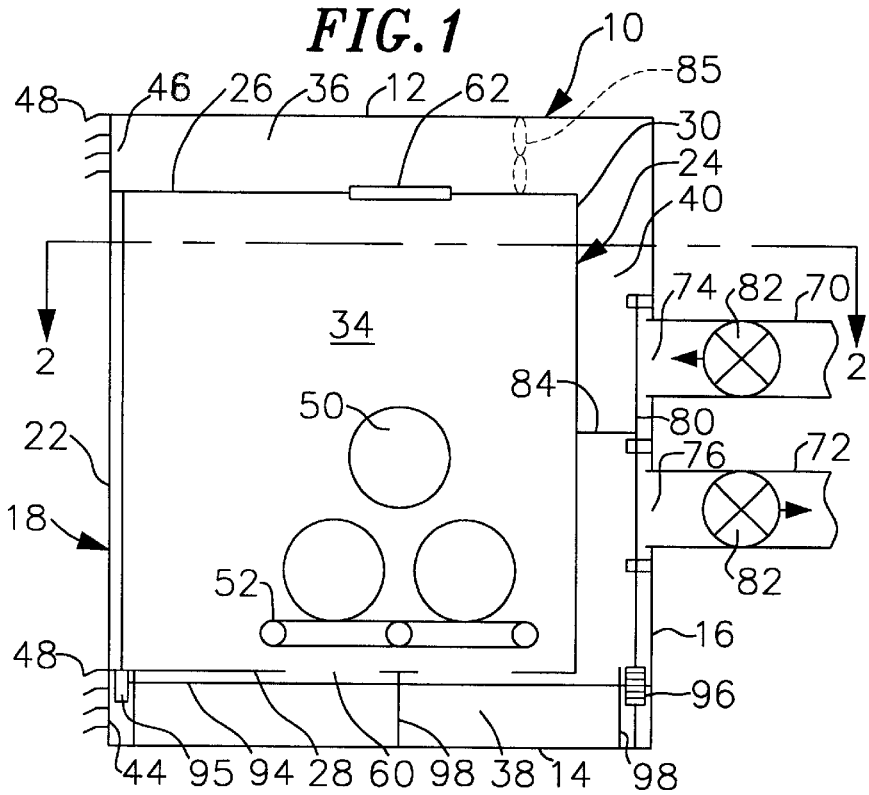
FIG. 1 is a side vertical cross sectional view of a preferred fireplace constructed in accordance with the present invention.
Figure 2:
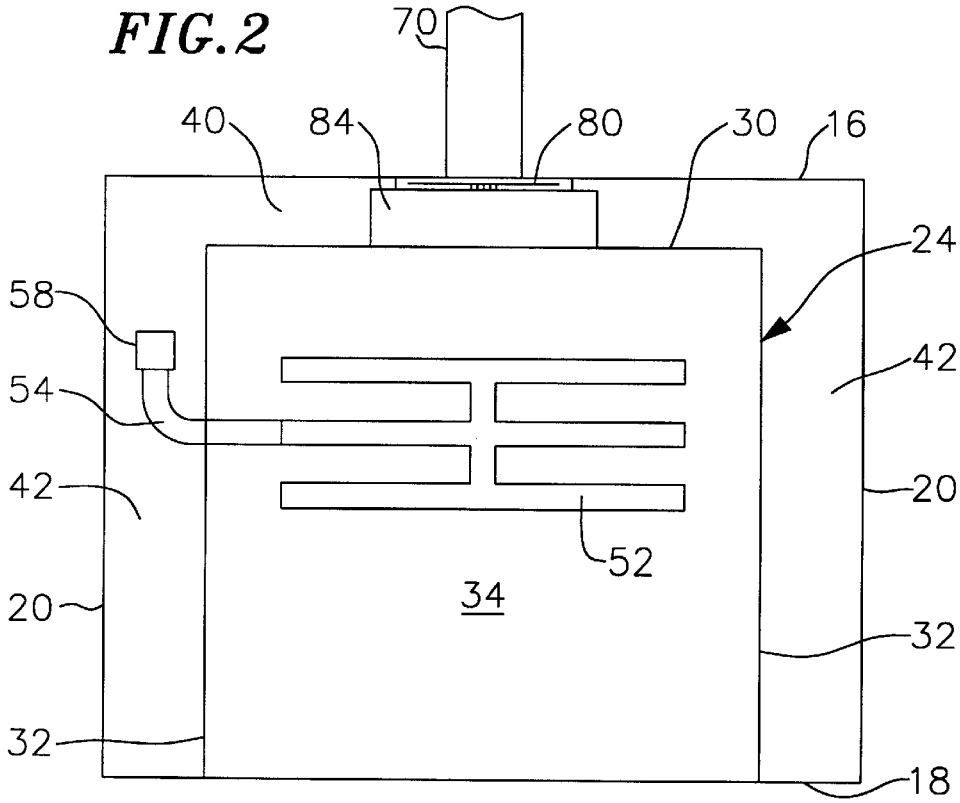
FIG. 2 is a horizontal cross-sectional view of the fireplace of FIG. 1.

A preferred room-exhausting gas fireplace constructed in accordance with the present invention is shown in FIGS. 1 and 2. The fireplace comprises a housing 10 having a top wall 12, bottom wall 14, rear wall 16, front wall 18, and two side walls 20. The front wall 18 comprises a glass panel 22. Within the housing 10, there is provided a firebox 24 having a top panel 26, bottom panel 28, rear panel 30 and two side panels 32. The firebox 24 in combination with the glass panel 22 forms a combustion chamber 34.

The panels of the firebox are spaced apart from the respective walls of the housing to thereby form a top plenum 36, bottom plenum 38, rear plenum 40, and two side plenums 42, all in communication with each other and forming a continuous room air plenum surrounding the firebox. A lower vent opening 44 is provided at the front of the fireplace to allow room air to enter the bottom plenum 36 and lower portion of the side plenum 42. An upper vent opening 46 is provided to allow air heated within the side plenums 42, rear plenum 40 and top plenum 36 to exit the fireplace into the room in which the fireplace is located. A decorative grill 48 or the like is mounted over each of the upper and lower vent openings.

Within the combustion chamber 34, there is provided one or more artificial logs 50, and a burner 52. A gas delivery tube 54 extends from the burner 52 through the side panel 32 of the firebox 24 to an adjustable valve 58 which is, in turn, connected to a source of gas. An ignitor, including a pilot (not shown) is provided within the firebox for igniting the gas/air mixture in the combustion chamber. The pilot is preferably part of an oxygen depletion sensor (ODS) 55 for monitoring the amount of oxygen in the room which is also provided within the firebox.

Openings 60 are provided in the bottom panel 28 of the firebox 24 to allow air in the bottom plenum 38 to enter the combustion chamber 34. Exhaust gases pass from the combustion chamber 34 through a catalytic converter 62 situated in an opening in the top panel 26 of the firebox 24 and into the top plenum 36. Openings 74 and 76 are provided in the rear wall 16 of the fireplace for receiving upper and lower vent pipes 70 and 72. The forward ends of vent pipes 70 and 72 extend slightly through the openings 74 and 76 into the rear plenum 40. The vent pipes 70 and 72 extend rearwardly from the rear wall 16 of the fireplace through a wall, preferably an exterior wall, of the room in which the fireplace is situated. In this arrangement the rear plenum 40 is in communication with the interior of vent pipes 70 and 72. A shutter 80 which is movable between open and closed positions is provided which acts as a door for opening and closing access to the interior of the vent pipes. When the shutter 80 is in its open position, a portion of the air flowing upwardly in the rear plenum 40 flows into and through the lower vent pipe 72 and is released outside of the room. Fresh outside air in turn, passes through the upper vent pipe 70 and into the rear plenum 40.

It is important that outside air entering the rear plenum 40 not flow downwardly in the rear plenum and into the combustion chamber 34. If this were to happen, the ODS in the combustion chamber 34 may not reflect the actual oxygen content of the room air. Rather, the ODS could give an erroneously high reading and would fail to shut off the fireplace if the oxygen content of the room air were to get too low.

To prevent outside air from entering the rear plenum 40 through the lower vent pipe 72 and then moving downwardly into the combustion chamber 34, a one-way valve 82 may provided in the lower vent pipe 72. The one-way valve 82 allows air to pass out of the lower vent pipe 72, but not in. Any suitable one-way valve 82 may be employed.

Rather than a one-way valve, there may be placed a small fan which is activated when the shutter is moved from its closed position into its open position. Similarly, there may be a small fan situated in upper vent pipe which is activated when the fan in the lower vent pipe is activated to maintain generally a constant pressure within the rear plenum. There may also be a one-way valve in the upper vent pipe which allows air to flow only from the outside into the rear plenum.

To prevent the outside air which enters the rear plenum 40 through the upper vent pipe 70 from moving downwardly and out of the lower vent pipe 72 or, more importantly, into the combustion chamber 34, there is provided a baffle 84 which extends rearwardly from the rear wall 30 of the firebox across at least a portion of the width of the rear plenum 40. The baffle 84 may be of any suitable shape, e.g. generally horizontal, curved, V-shaped or the like, which prevents the fresh outside air from moving downwardly in the rear plenum 40. Alternatively, the baffle 84 could extend forwardly from the shutter 80 or rear wall of the housing 10.

Figure 3:
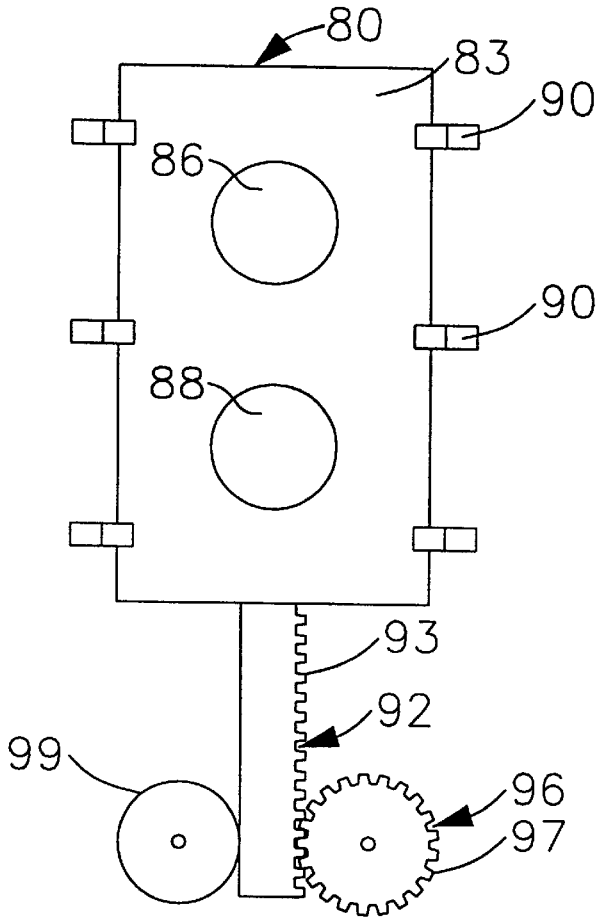
FIG. 3 is an enlarged front view of the shutter of the fireplace of FIG. 1.
Figure 4:
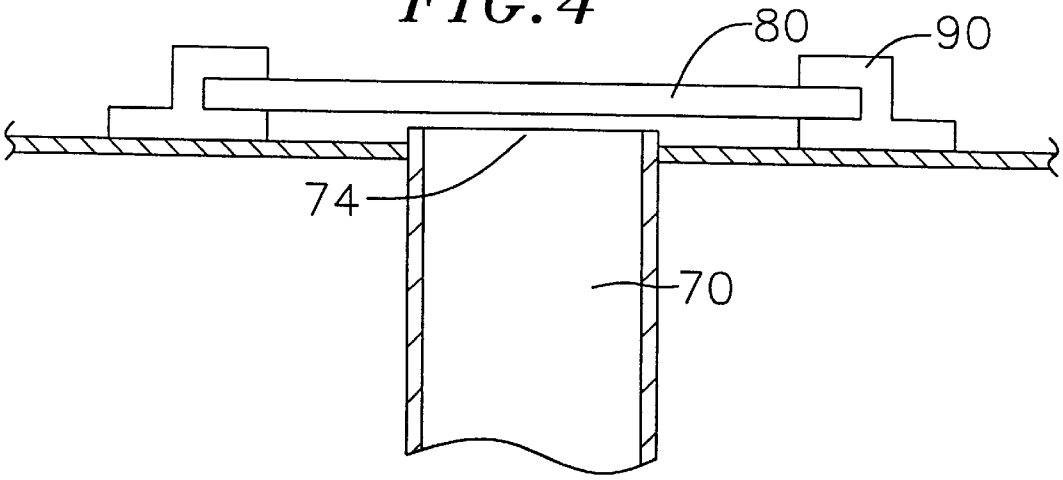
FIG. 4 is a horizontal cross sectional view looking down on the shutter of the fireplace of FIG. 1.

As shown in FIGS. 3 and 4, the shutter 80 comprises a generally flat rectangular panel 83 having upper and lower holes 86 and 88 which corresponds in shape and size to the openings 74 and 76 in the rear wall 16 to the upper and lower vent pipes 70 and 72. The shutter 80 is slidably retained against the rear wall 16 by a plurality of brackets 90. Vertical movement of the shutter is effected by a rack and pinon mechanism comprising a generally vertical rack 92 which extends downwardly from the rectangular panel 83 of the shutter 80. The rack 92 has a plurality of teeth 93 along one lateral edge. An elongated shaft 94 having a handle 95 at its forward end (See FIG. 1) extends across the bottom plenum 38 from the front of the fireplace to the rear wall 16, the shaft 94 being rotatably fixed in position by brackets 98. The handle 95 is situated behind the lower grill 48 which is hingedly movable to provide access to the handle. A generally circular spur gear or pinon 96 is fixedly attached to the shaft 94 adjacent the rear end of the shaft, the teeth 97 of the pinon 96 intermeshing with the teeth 93 of the rack 92. A generally circular, rotatable guide 99 is mounted on the rear wall 16 of the housing to maintain engagement of the teeth of the rack 92 and plenum 96. In this arrangement, rotation of the shaft 94 by manually turning the handle 95 moves the shutter upwardly or downwardly depending on the direction of rotation of the handle 95.

By adjusting the shutter 80 between its open and closed positions, an operator can adjust the amount of warmed air flowing out of and cool in flowing into the rear plenum 40. This is turn allows the operator to reduce the amount of heat and moisture vented by the fireplace into the room while still allowing the fireplace to operate with a large attractive flame.

It is understood that if circumstances are such that fresh cool air from the inlet vent pipe will not reach the combustion chamber, a baffle across the rear plenum between the inlet and outlet openings is unnecessary. This might occur, for example, if the flow of air in the room and plenum is sufficient to carry with it any cool fresh air entering the room and plenum. The provision of a fan to increase the flow of air through the room and plenum may obviate the need for a baffle between the inlet and outlet pipes. A substantial spacing between the inlet and outlet vent pipes may also obviate the need for a baffle between the two.

Figure 5:
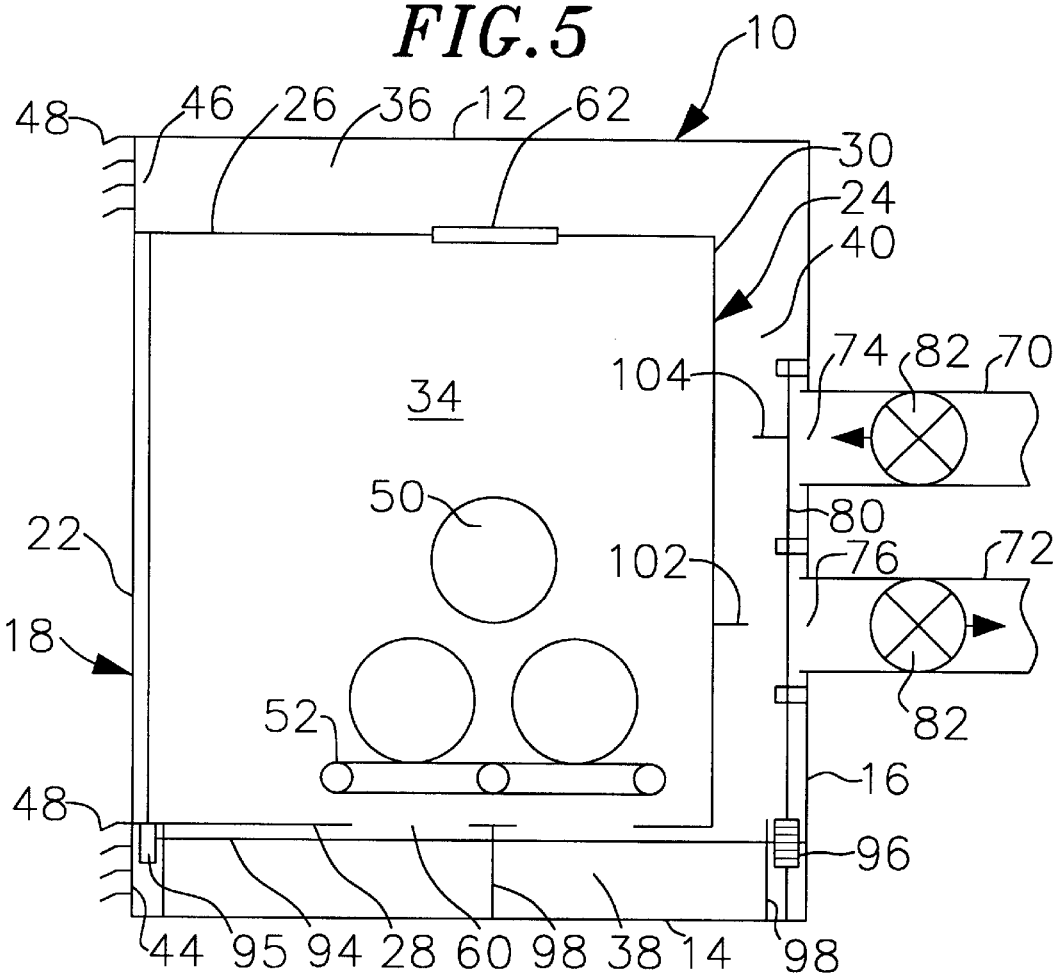
FIG. 5 is a side vertical cross-sectional view of another preferred fireplace constructed in accordance with the present invention.

If a baffle is used, it may have any form which prevents fresh air from the inlet vent pipe from traveling downward in the rear room air plenum and into the combustion chamber. Likewise two or more baffles may combine to satisfy this function . For example, FIG. 5 shows an arrangement wherein a first baffle 102 extends rearwardly from the rear panel 30 of the firebox 24 to about the mid point of the rear plenum 40. A second baffle 104 extends from the middle of the shutter 80 forwardly to about the mid point of the rear plenum 40. The first and second baffle 102 and 104 are arranged so that when the shutter 80 is in its closed position, the baffles 102 and 104 are vertically spaced apart. When the shutter 80 is in its open position, the baffles 102 and 104 are positioned adjacent and edge-to-edge to each other. When the baffles 102 and 104 are separated, air in the rear plenum 40 can flow easily by the baffles 102 and 104. When together, air in the rear plenum 40 must flow laterally around the baffles 102 and 104. This efficiently prevents cool air entering the rear plenum 40 from the upper inlet vent pipe 70 from flowing downwardly in the rear plenum 40 and into the combustion chamber 34.

It should be understood that any linkage arrangement which enables a user to adjust the shutter 80 may be used. It should also be understood that the means for adjustably blocking the vent pipe openings need not be a single panel slidably moveable between opened and closed positions. For example, a separate shutter may be associated with each vent opening, each shutter being slidable between opened and closed positions with respect to its associated vent pipe opening. In such an embodiment, the shutters may be coupled to each other so as to open and close together or the shutters may be operated independently by providing each with a separate mechanism for effecting slidable movement of the shutter. For example, each shutter may have associated with it a mechanism as described with reference to the embodiment of FIG. 1.

Figure 6:
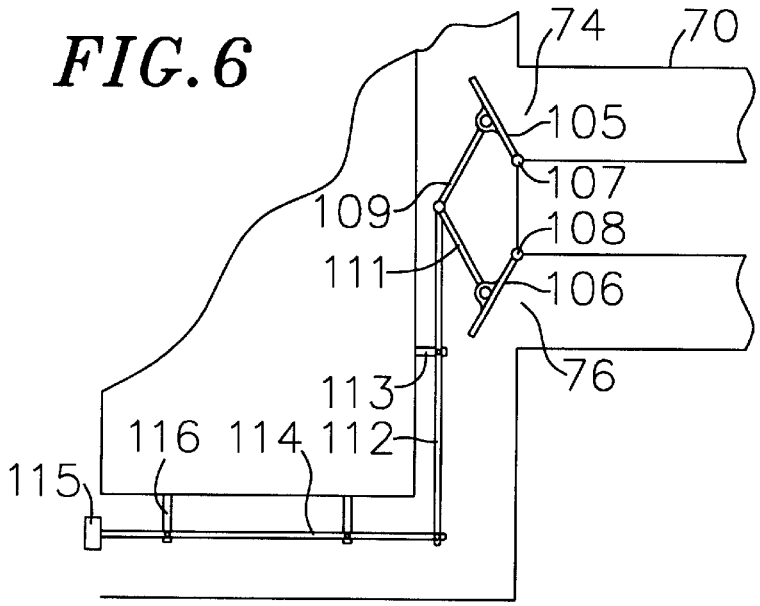
FIG. 6 is a partial side cross-sectional view of the fireplace depicting a mechanical arrangement for controlling the shutters which control air flow through the vent openings.

Rather than a slidable shutter panel or panels, each vent pipe opening may have an associated hinged panel which acts as a door that can be opened and closed. With reference to FIG. 6, there is shown an arrangement comprising an upper shutter 105 pivotally attached to the rear housing wall 16 at a position below the upper vent pipe opening 74 and a lower shutter 106 pivotally attached to the rear housing wall 16 at a position above the lower vent pipe opening 76 by hinges 107 and 108 respectively. Upper and lower pivot arms 109 and 111 are hingedly attached to the front surface of the upper and lower shutter doors 105 and 106, respectively. The forward ends of the upper and lower pivot arms 109 and 111 are pivotally connected to the upper end of a lever arm 112 which is pivotally mounted on bracket 113 and is afforded pivotal movable between first and second positions. In the second position, the shutters 105 and 106 are in their closed positions. In the first position the shutters 105 and 106 are in their open positions. The lower end of the lever arm 112 is pivotally connected to a generally horizontal shaft 114 which extends towardly through the bottom plenum to the front of the fireplace. The shaft 114 is mounted on suitable brackets 116 which afford the shaft 114 lengthwise slidable movement. A knob 115 is attached to the forward end of the shaft 114. In this arrangement, pulling the knob 115 and shaft 114 forward results in the shutters 105 and 106 moving to their closed positions. Pushing of the knob 115 and shaft 114 results in movement of the shutters 105 and 106 toward their open positions.

Figure 7:
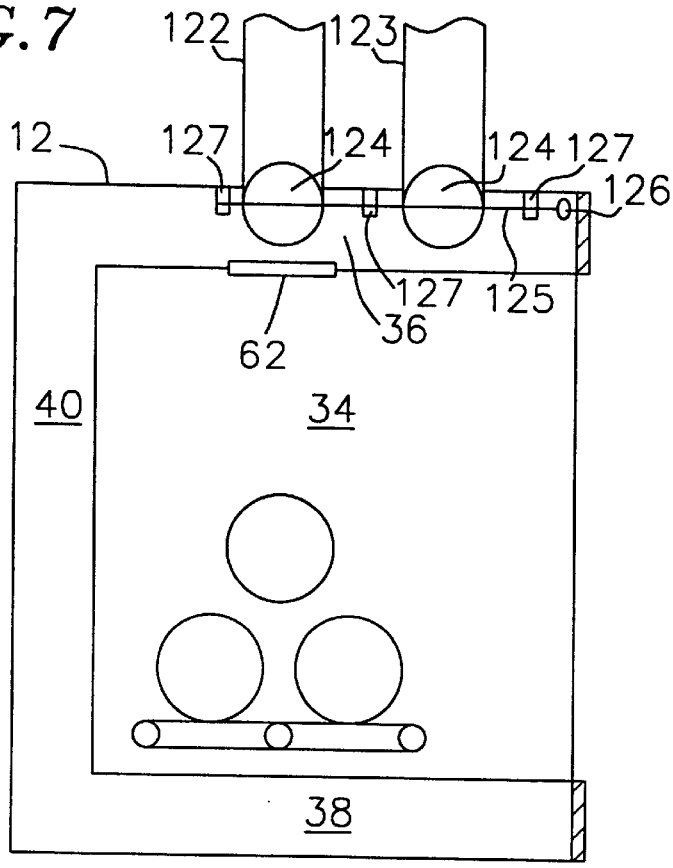
FIG. 7 is a cut-away, side, vertical cross-sectional view of another preferred fireplace constructed in accordance with the present invention.

FIG. 7 shows yet another embodiment of the invention. In this embodiment, an outlet opening and inlet opening are located in the top wall 12 of the fireplace housing. Generally vertical outlet and inlet vent pipes 122 and 123 extend through the openings and into the top plenum 36 a short distance. Each of the outlet and inlet pipes 122 and 123 comprises a circular baffle 124 rotatably mounted inside the vent pipe. The baffles 124 are fixedly mounted on a rod 125 which extends through holes in the sides of the inlet and outlet vent pipes. The rod 125 has a rotatable handle 126 at its forward end which is located at the front of the fireplace at a position just behind the top decorative grill 48 which, in this embodiment is hingedly mounted on the fireplace so that it may be opened to provide access to the handle. The rod 125 is rotatably mounted in the top plenum by brackets 127, In this arrangement, rotation of the rod handle opens or shuts the circular baffles 124 simultaneously.

Figure 8:
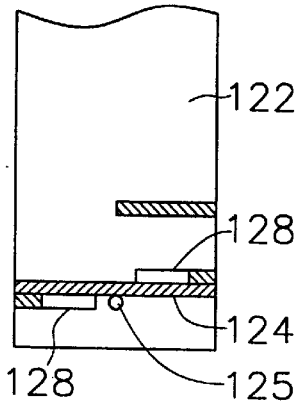
FIG. 8 is a vertical correctional view of the outlet vent pipe of the fireplace of FIG. 7 showing the baffle in its closed position.
Figure 9:
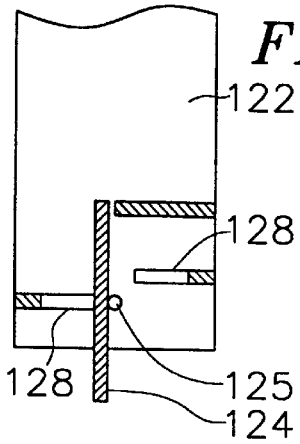
FIG. 9 is a vertical correctional view of the outlet vent pipe of the fireplace of FIG. 7 showing the baffle in its open position.
Figure 10:
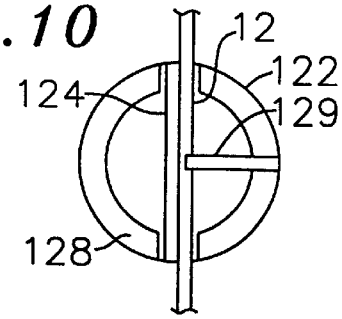
FIG. 10 is horizontal cross-sectional view of the outlet pipe of the fireplace of FIG. 7 showing the baffle in its open position.

Preferably one or both of the outlet and inlet vent pipes 122 and 123 comprises stops indicating the fully open, i.e., vertical, and closed, i.e., horizontal, positions. With reference to FIGS. 8–10, preferred stops for the closed position, comprise a pair of semicircular ring-like flanges 128 extending horizontally into the interior of the vent pipe, one above and one below the baffle 124. In the closed position, the outer edges of the baffle 124 engage the flanges 128, preventing rotatable movement of the baffle 124 beyond its closed position. For the open position, the stop comprises a horizontal bar 129 which extends inwardly to about the mid-point of the vent pipe. The direction of the bar 129 is transverse to the direction of rod 125. The bar 129 is situated so that the baffle 124 engages the free end of the bar 129 when the baffle 124 reaches its fully open, i.e., vertical, position.

Figure 11:
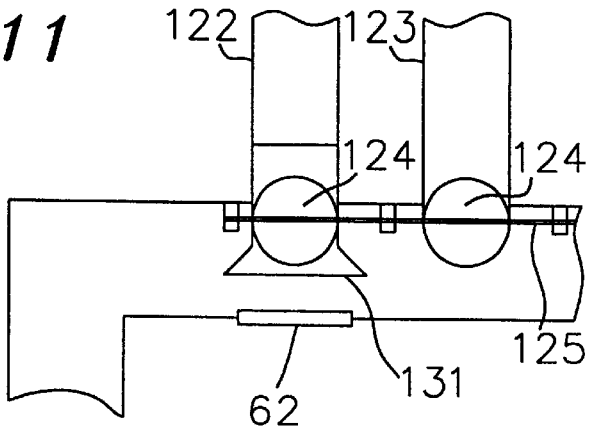
FIG. 11 is a cutaway, side, vertical cross-sectional view of yet another preferred fireplace constructed in accordance with the present invention.
Figure 12:
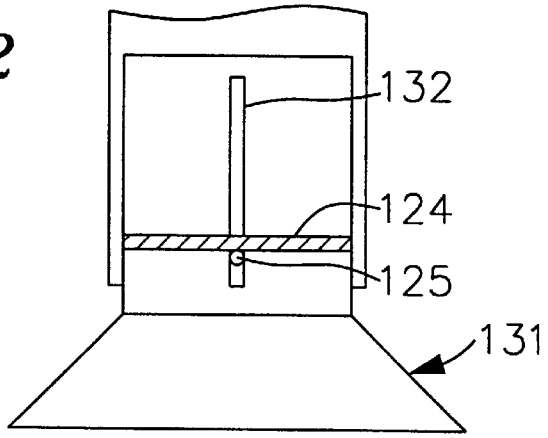
FIG. 12 is an enlarged, side vertical cross-sectional view of the outlet pipe of the fireplace of FIG. 11 showing the stack.

In the embodiment shown in FIGS. 11 and 12, to further reduce the amount of heat and water vapor present in the air which is exhausted into the room, the outlet pipe 122 further comprises a movable stack 131 which can be raised or lowered over the catalytic converter 62. The stack 131 comprises an upper cylindrical portion and a lower frustoconical portion. The diameter of the upper portion is slightly smaller than the inside diameter of the outlet vent pipe 122. The upper cylindrical portion is slidably mounted inside the lower portion of the outlet vent pipe 122 with the baffle 124 rotatably positioned inside of the cylindrical portion of the stack 131. The cylindrical portion of the stack 131 comprises a pair of diametrically opposed vertical slots 132 through which the rod 125 on which the baffles 124 are mounted extends. The diameter of the bottom edge of the lower portion of the stack 131 is preferably sufficient so that the lower edge of the stack extends completely around the catalytic converter 62 when the stack 131 is lowered into its lowest position engaging the top panel of the firebox.

Figure 13:
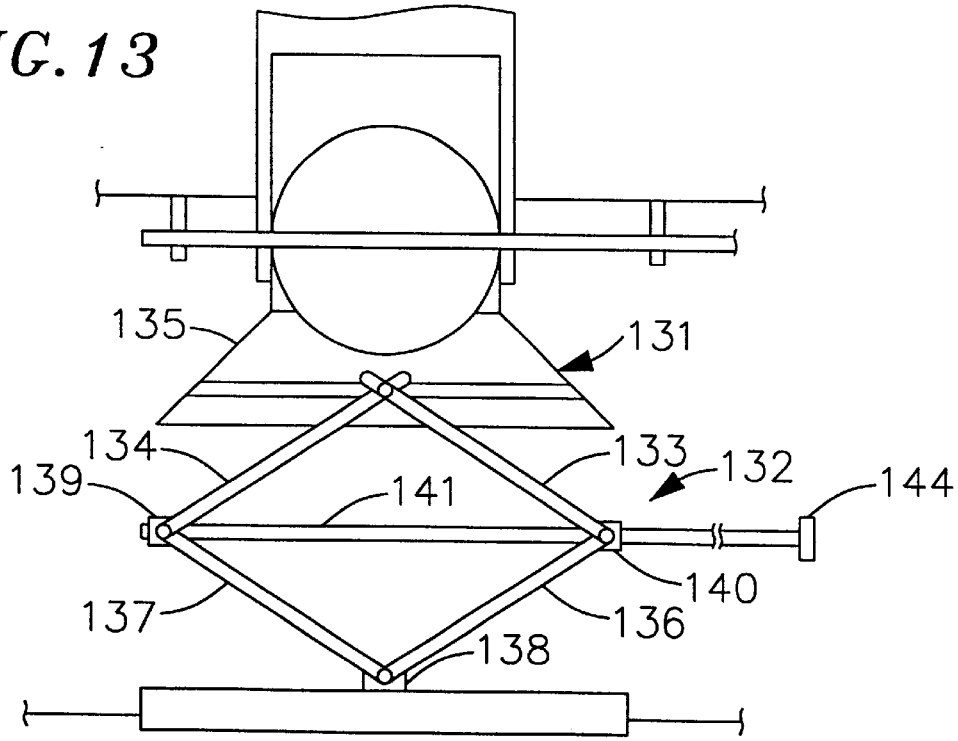
FIG. 13 is an enlarged, side vertical cross-sectional view of the outlet pipe of the fireplace of FIG. 11 showing a preferred lifting mechanism for the stack.

To raise and lower the stack 131, there is also provided a lifting mechanism. In the preferred embodiment shown in FIG. 13, the lifting mechanism 132 comprises a pair of upper support members 133 and 134 pivotally connected at their upper ends and the center of a cross bar 135 extending diametrically across the interior of the frustoconical section of the stack 131. The lifting mechanism 132 further comprises a pair of lower support members 136 and 137 pivotally connected together at their lower ends and to a bracket 138 extending across the top of the catalytic converter. The lower end of each upper support is pivotally attached to the upper end of each lower support by brackets 139 and 140. Brackets 139 and 140 each comprise a hole through which shaft 141 passes. The first end of shaft 141 is rotatably fixed to bracket 139 by means of flanges 142 and 143. The shaft 141 and hole 140 comprise inter engaging threads. In this arrangement, rotation of the shaft by rotating handle 144 causes brackets 139 and 140 to move closer together or further apart, depending on the direction of rotation. Movement of the brackets toward and away from each other raises and lowers the stack 131.

It is understood that, if present, any means for raising and lower stack, whether manual or automatic, may be used.

Figure 16A:
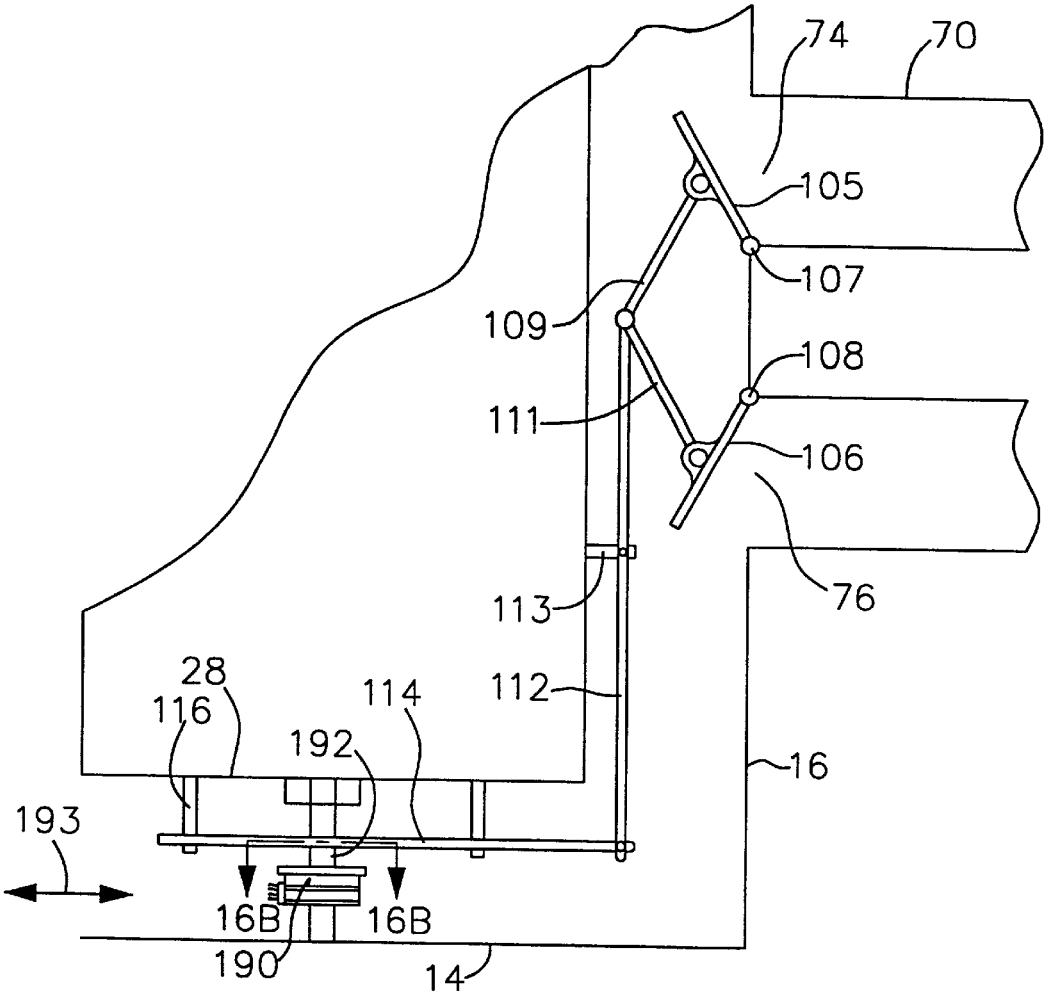
FIG. 16A is a partial side cross-sectional view of a fireplace depicting a mechanical arrangement similar to that shown in FIG. 6 which is driven by a motor.
Figure 16B:
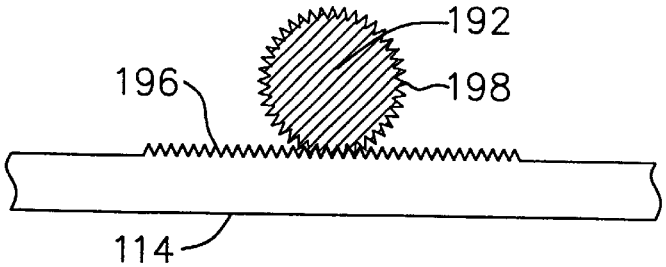
FIG. 16B is a cross-sectional view of the rack and pinion mechanism employed by the mechanical arrangement shown in FIG. 16A.

In the embodiments described above, the door or doors controlling the openings to the inlet and outlet vents, whether a sliding shutter, hinged door, rotatable baffle or otherwise, are manually controlled. It is understood that any suitable linkage for manually opening and closing such door(s) may be used. Further, it is understood that automatic means for opening and closing the door(s) may be used if desired. For example, each of the hinged doors shown in FIG. 6 may be opened and shut by a separate small reversible motor 190 such as shown in FIG. 16A. The motor 190 rotatably drives a shaft 114. The motor is coupled to the bottom wall 14. The motor drives a motor shaft 192. The end of the shaft 192 opposite the motor is rotatably coupled to the bottom panel 28. Longitudinal gears 198 are formed on a longitudinal portion of the motor shaft 192 (FIG. 16B) Transverse gears 196 are formed on a portion of the shaft 114. The gears 198 of the motor shaft 192 are coupled to the gears 198 of the shaft 114 forming a rack and pinion mechanism. As a result as the reversible motor rotates the motor shaft back and forth, it causes shaft 114 to translate in the back and forth direction 193. This translational motion causes the lever arm 112 to pivot about bracket 113 causing the shutters 105 to move to and from their closed position as earlier described in relation with FIG. 6. Other motor arrangements incorporating a single or multiple motors may also be used. For example, a motor may be used to open or close a single shutter, or to open or close both shutters simultaneously if desired. The motors typically would be controlled by a switch accessible at the front of the fireplace or at any other desired location.

Alternatively, the motors could be automatically controlled by a thermostat located either inside or outside of the fireplace housing. In essence the thermostat will close or break the electrical circuit which provides power to drive the motors when the temperature at a predetermined location inside the fireplace reaches a predetermined level. Instead of a thermostat, a controller may be used which would close or break the electrical circuit based on other factors such as for example, the level of carbon monoxide or the level of humidity.

Figure 17:
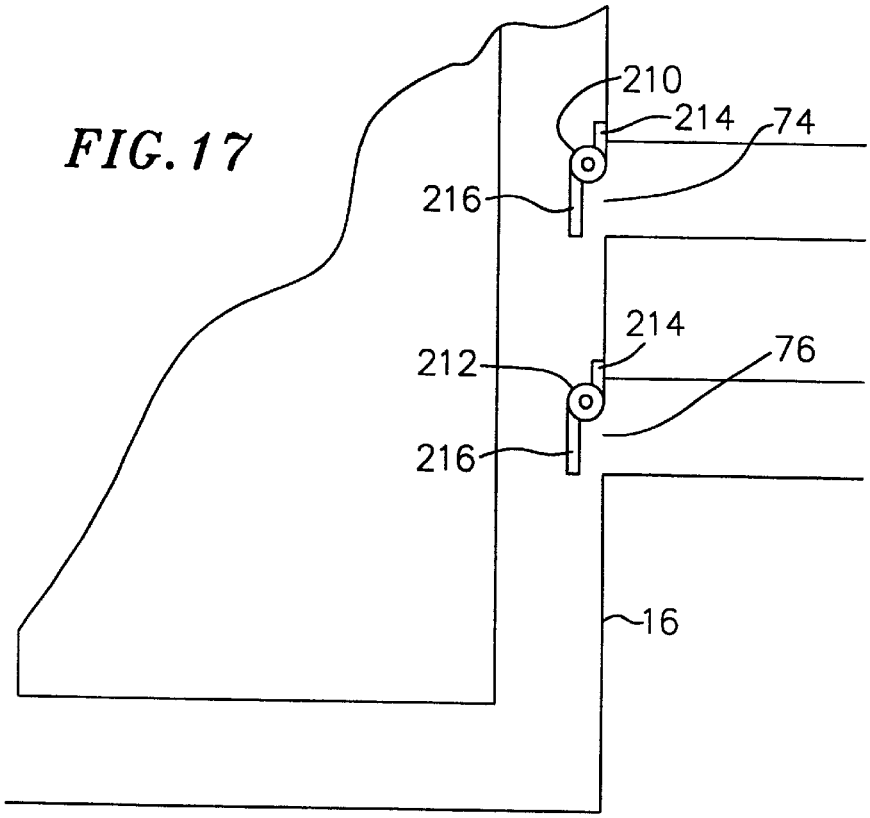
FIG. 17 is a partial side cross-sectional view of a fireplace which employs bimetal springs for controlling the shutters which control the air flow through the outlet vents.

As yet another alternative, opening and closing of the shutters may be controlled by a spring or the like which bends, expands, contracts or otherwise changes shape as a result of an increase or decrease in temperature. Preferably springs 210, 212 are used which are made from a bimetal and are mounted to the fireplace as shown in FIG. 17. Each of the springs 210, 212 has a first end 214. The first end of each spring is attached to the wall 16 of the fireplace housing surrounding a vent opening. A shutter 216 is attached to the second end of each spring. The bimetal springs will preferably be in the "open" position (shown in FIG. 17) until the temperature cools to about 70° F. Once at this temperature or at a cooler temperature, the springs "coil" causing the shutters to block the openings 74 and 76.

Figure 18:
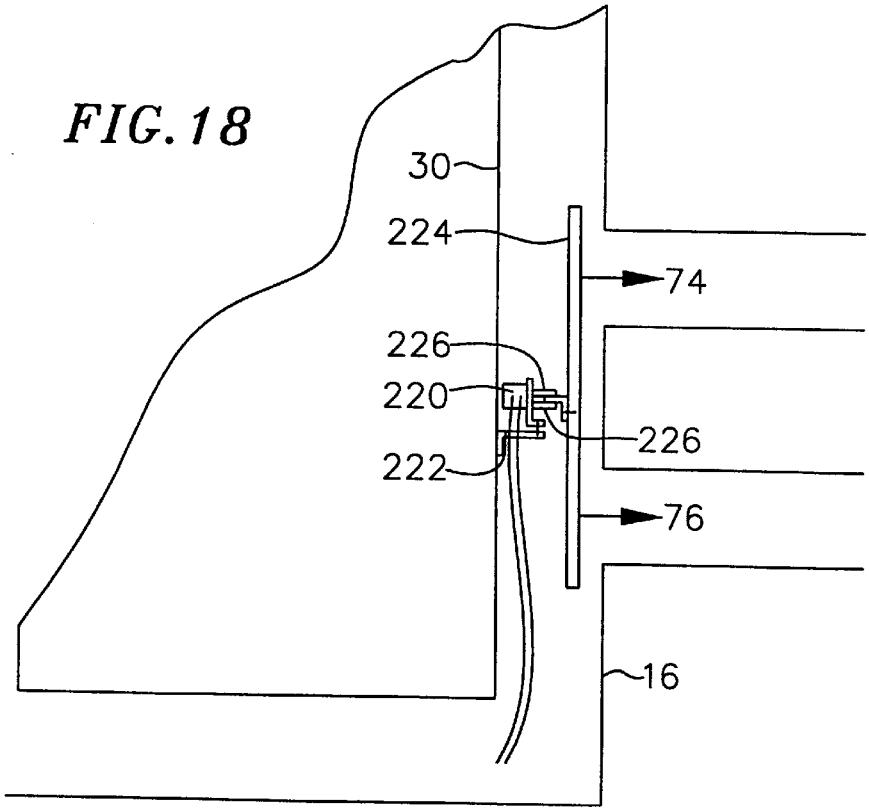
FIG. 18 is a partial side cross-sectional view of a fireplace which employs a solenoid motor for controlling the shutter which controls air flow through the outlet vents.

In yet a further embodiment, a solenoid 220 is coupled to the rear panel 30 of the fireplace (FIG. 18). Typically, the solenoid is mounted on a bracket 222 which is attached to the fireplace rear panel. The solenoid has arms 226. A shutter 224 is coupled to the solenoid arms and is aligned so as to block the openings 74, 76 when the arms are extended. The solenoid may be activated by the operator by turning on a switch or it may be coupled to a thermostat or controller circuit for automated operation. Once the solenoid is activated, its arms are extended causing the shutter to move into position and block the openings 74, 76.

Figure 14:
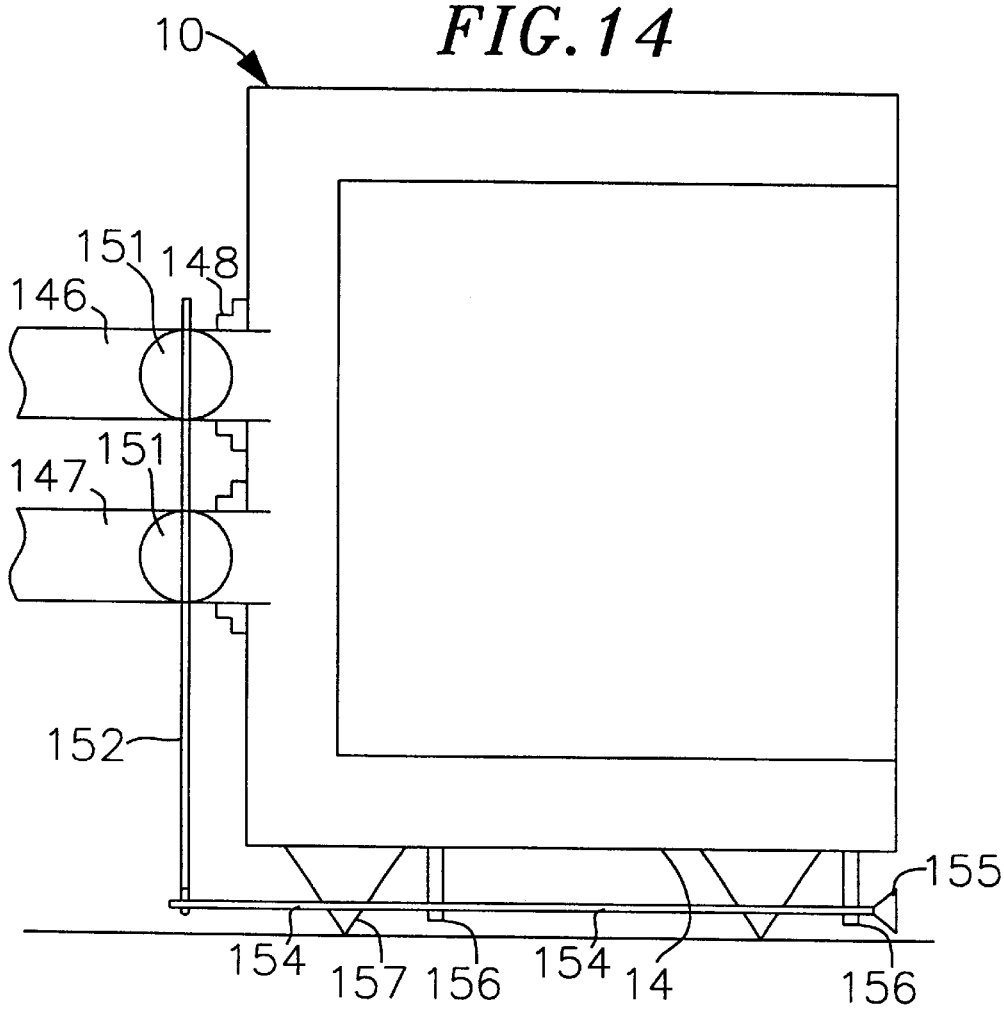
FIG. 14 is a side vertical cross sectional view showing a preferred adapter constructed in accordance with the present invention installed on a fireplace.

The present invention further provides an adapter kit for an existing ventless gas fireplace having a room air plenum surrounding at least a portion of a firebox, and in which inlet and outlet openings are provided in the exterior walls of the fireplace. With reference to FIG. 14 a presently preferred adapter comprises a generally horizontal inlet vent pipe 146 and a generally horizontal outlet vent pipe 147 and brackets 148 for attaching each of the inlet and outlet vent pipes to the exterior wall of the fireplace 10 such that the inlet and outlet vent pipes 146 and 147 extend into the inlet and outlet openings respectively. Means are provided for reversibly blocking air into the room air plenum from flowing into the outlet vent and fresh air in the inlet vent pipe from flowing into the room air plenum.

Figure 15:
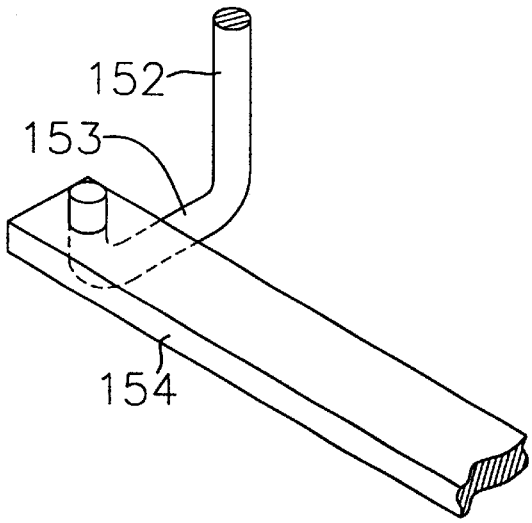
FIG. 15 is an enlarged view of the connection between the rod and shaft of the adapter of FIG. 14.

In the embodiment shown in FIG. 14, the reversible blocking means comprises a rotatable circular vertical baffle 151 mounted in each of the horizontal inlet and outlet vent pipes 146 and 147 as described with reference to the embodiment of FIG. 11. Each of the baffles 151 is connected along its vertical diameter by a rod 152. The rod 152 extends downwardly from the inlet vent pipe 147 to a level below the bottom wall 14 of the fireplace housing 10 where it terminates in a generally horizontal foot 153 (FIG. 15). A shaft 154 is pivotally attached to the end of the foot 153 and extends forwardly between the bottom wall 14 and the floor of the room in which the fireplace is situated, the bottom wall 14 being spaced apart from the floor by feet 157 supported by brackets 156. The forward end of the second rod has a knob 155 positioned adjacent and just behind the decorative grill. In this arrangement, lengthwise movement, i.e., pushing and pulling of the second rod results in rotational movement of the first rod, and hence, opening and closing movement of the circular baffles. It is apparent that a gear connection between the first and second rods may be provided so that rotation of the knob results in rotation of the first and second baffles. Moreover, it is understood that any mechanism, as for example the mechanisms described herein, may be used for blocking and unblocking the vent pipes.

It is also understood that the size, shape, arrangement and number of plenums in the fireplace may vary as desired. A plenum outside of the firebox is needed however from which warm or hot air or gas may be drawn off and into which cool outside air may be introduced.

The invention herein is particularly applicable to conventional room exhausting fireplaces such as ventless fireplace inserts. It is also applicable to conventional closed combustion or vented fireplaces. In such fireplaces, the exhaust is carried from the combustion chamber to a location outside of the room. In such gas fireplaces, utilization of the present invention would enable control of the temperature of air exiting the room air plenum surrounding the firebox without reducing the flame within the firebox. In this regard, the fireplace may be any factory built fireplaces, e.g., a free-standing unit, zero-clearance unit or a fireplace insert. The invention is equally applicable to heaters having a combustion chamber and at least one plenum outside of the combustion chamber from which warm or hot air may be withdrawn and cool air introduced.

As can be seen, there are many modifications and changes which can be made to the embodiments shown in the drawings and described above without departing from the meaning and scope of the invention. Accordingly, the present invention is not meant to be limited to the particular embodiments described above. Rather the invention is meant to be defined by the following claims which are to be given their broadest fair scope.

What is claimed is:

1. A gas fireplace comprising:

a housing;

a firebox within the housing forming a combustion chamber, wherein combustion products are generated in the combustion chamber during the combustion of gas;

a plenum between the firebox and the housing from which heated gases are vented into the room in which the fireplace is installed, wherein flow within the plenum is from upstream to downstream;

an opening in the firebox in communication with the plenum allowing for at least a portion of the combustion gases generated in the combustion chamber to pass to the plenum;

a vent pipe attachable to the housing whereby the interior of the vent pipe is in communication with the plenum for venting the plenum through the vent pipe to a location outside of the room where the fireplace is located; and means for controlling the amount of venting of the plenum through the vent pipe.

2. A gas fireplace as recited in claim 1 wherein the vent pipe is in communication with the plenum at a location downstream of the opening.

3. A gas fireplace as recited in claim 1 wherein the vent pipe is in communication with the plenum at a location upstream of the opening.

4. A gas fireplace as recited in claim 1 wherein the vent pipe is in communication with the plenum at a location immediately adjacent the opening and higher than the opening relative to a base of the fireplace.

5. A gas fireplace comprising:

a housing;

a firebox within the housing;

a plenum between the firebox and the housing from which heated gases are vented into the room in which the fireplace is installed;

a vent pipe attachable to the housing whereby the interior of the vent pipe is in communication with the plenum so that cool gas may be introduced into the plenum through the vent pipe; and means for controlling the amount of cool gas introduced into the plenum through the vent pipe.

6. A method for controlling the level of a combustion product generated by a gas fireplace in a room where the fireplace is located, the gas fireplace having a firebox forming a combustion chamber, a plenum around at least a portion of the firebox having an entrance for receiving room air and an exit for exhausting said room air into the room where the fireplace is located wherein flow within the plenum is from upstream to downstream, and an opening in the firebox for allowing at least a portion of combustion gases generated in the firebox to pass to the plenum, the method comprising the steps:

determining the level of the combustion product in the room; and venting the plenum from a location prior to the plenum exit to a location outside of the room where the fireplace is located when the level of the combustion product in the room is above a predetermined level.

7. A method as recited in claim 6 wherein the combustion product is selected from the group consisting of carbon monoxide, carbon dioxide, nitrogen dioxide, moisture and heat.

8. A method as recited in claim 6 wherein the step of venting the plenum comprises venting the plenum from a location upstream of the opening.

9. A method as recited in claim 6 wherein the step of venting the plenum comprises venting the plenum from a location downstream of the opening.

10. A method as recited in claim 6 wherein the step of venting the plenum comprises venting the plenum from a location immediately adjacent the opening and higher than the opening relative to a base of the fireplace.

11. A method as recited in claim 6 further comprising the step of introducing cool air into the plenum at a location downstream from the venting location.

12. A method as recited in claim 11 further comprising the step of preventing the introduced cool air from flowing upstream in the plenum.

13. A method for controlling the level of at least one condition selected from the group consisting of heat and moisture generated by a gas fireplace in a room where the fireplace is located, the gas fireplace having a firebox forming a combustion chamber, a plenum around at least a portion of the firebox having an entrance for receiving room air and an exit for exhausting said room air into the room where the fireplace is located wherein flow within the plenum is from upstream to downstream, and an opening in the firebox for allowing at least a portion of the combustion gases generated in the firebox to pass to the plenum, the method comprising the steps:

determining the level of the at least one condition in the room; and introducing cool air to the plenum at a location after the entrance but before the exit when the level of the condition in the room is above a predetermined level.

14. A method as recited in claim 13 wherein the step of introducing cool air comprises introducing cool air to the plenum at a location downstream from the opening.

15. A method as recited in claim 13 wherein the step of introducing cool air comprises introducing cool air to the plenum at a location upstream from the opening.

16. A method as recited in claim 13 further comprising the step of preventing the introduced cool air from flowing upstream in the plenum.

17. A method as recited in claim 13 further comprising the step of venting the plenum from a location between the plenum entrance and exit to a location outside of the room where the fireplace is located.

* * * * *

UNITED STATES PATENT AND TRADEMARK OFFICE

CERTIFICATE OF CORRECTION

PATENT NO. : 6,227,194 B1 
DATED : May 8, 2001
INVENTOR(S) : Samir E. Barudi, Rodger Duke Mitchell, and John R. Kelly, deceased It is certified that error appears in the above-identified patent and that said Letters Patent is hereby corrected as shown below:

Title page,
Item [56], References Cited, under "OTHER PUBLICATIONS" insert the following references: -- Guardian Solenoids, Newark (1 page) --.

Item [57], ABSTRACT,
Line 7, replace "plenum. a" with -- plenum. A --.

Signed and Sealed this

Ninth Day of July, 2002

*Attest:*

*Attesting Officer*

JAMES E. ROGAN
*Director of the United States Patent and Trademark Office*